US008814757B2

(12) United States Patent
Eschenbach

(10) Patent No.: US 8,814,757 B2
(45) Date of Patent: Aug. 26, 2014

(54) FREE PACE ELLIPTICAL EXERCISE APPARATUS

(76) Inventor: Paul William Eschenbach, Roebuck, SC (US)

( * ) Notice: Subject to any disclaimer, the term of this patent is extended or adjusted under 35 U.S.C. 154(b) by 416 days.

(21) Appl. No.: 13/385,425

(22) Filed: Feb. 21, 2012

(65) Prior Publication Data

US 2012/0178589 A1 Jul. 12, 2012

Related U.S. Application Data

(63) Continuation-in-part of application No. 12/799,909, filed on May 5, 2010, now Pat. No. 8,133,159.

(51) Int. Cl.

| | |
|---|---|
| ***A63B 22/00*** | (2006.01) |
| ***A63B 22/02*** | (2006.01) |
| ***A63B 22/20*** | (2006.01) |
| ***A63B 21/015*** | (2006.01) |
| ***A63B 21/00*** | (2006.01) |
| *A63B 22/06* | (2006.01) |
| *A63B 24/00* | (2006.01) |

(52) U.S. Cl.

CPC ..... *A63B 21/015* (2013.01); *A63B 22/201* (2013.01); *A63B 22/0023* (2013.01); *A63B 2022/0676* (2013.01); *A63B 21/00069* (2013.01); *A63B 22/001* (2013.01); *A63B 22/0664* (2013.01); *A63B 2022/206* (2013.01); *A63B 24/0087* (2013.01)

USPC ..... 482/52; 482/62

(58) Field of Classification Search

CPC ..... A63B 22/001; A63B 22/0664; A63B 2022/067; A63B 22/0015; A63B 2022/0676; A63B 21/225; A63B 22/0023; A63B 21/0053

USPC ..... 482/51–52, 57–65, 79–80

See application file for complete search history.

(56) References Cited

U.S. PATENT DOCUMENTS

| | | | | |
|---|---|---|---|---|
| 6,045,487 | A * | 4/2000 | Miller | 482/52 |
| 6,045,488 | A * | 4/2000 | Eschenbach | 482/52 |
| 6,142,915 | A * | 11/2000 | Eschenbach | 482/52 |
| 6,398,695 | B2 * | 6/2002 | Miller | 482/52 |
| 7,507,184 | B2 | 3/2009 | Rodgers, Jr. | 482/52 |
| 7,520,839 | B2 | 4/2009 | Rodgers, Jr. | 482/52 |
| 7,530,926 | B2 | 5/2009 | Rodgers, Jr. | 482/52 |
| 7,608,018 | B2 | 10/2009 | Chuang et al. | 482/52 |
| 7,811,206 | B2 * | 10/2010 | Chuang et al. | 482/52 |
| 7,828,698 | B2 | 11/2010 | Rodgers, Jr. | |
| 7,841,968 | B1 | 11/2010 | Eschenbach | 482/52 |
| 7,922,625 | B2 | 4/2011 | Grind | 482/52 |
| 7,938,754 | B2 | 5/2011 | Eschenbach | 482/52 |
| 7,942,787 | B2 | 5/2011 | Ohrt et al. | 482/52 |
| 7,988,600 | B2 | 8/2011 | Rodgers, Jr. | 482/52 |
| 8,021,275 | B2 | 9/2011 | Rodgers, Jr. | 482/52 |
| 8,079,937 | B2 * | 12/2011 | Bedell et al. | 482/4 |
| 8,092,351 | B1 | 1/2012 | Rodgers, Jr. | 482/52 |
| 8,133,159 | B2 * | 3/2012 | Eschenbach | 482/52 |
| 8,668,627 | B2 * | 3/2014 | Eschenbach | 482/52 |
| 2009/0105049 | A1 | 4/2009 | Miller | 482/52 |
| 2009/0156369 | A1 | 6/2009 | Rodgers, Jr. | 482/52 |
| 2009/0156370 | A1 | 6/2009 | Rodgers, Jr. | 482/52 |
| 2009/0181828 | A1 | 7/2009 | Rodgers, Jr. | 482/52 |
| 2011/0172062 | A1 | 7/2011 | Miller | 482/52 |
| 2012/0004077 | A1 * | 1/2012 | Chu | 482/52 |
| 2012/0115685 | A1 * | 5/2012 | Bedell et al. | 482/52 |

* cited by examiner

*Primary Examiner* — Stephen Crow

(57) ABSTRACT

The present invention relates to a standup exercise apparatus that simulates walking and jogging with arm exercise. More particularly, the present invention relates to an exercise machine having separately supported pedals for the feet and arm exercise coordinated with the motion of the feet where the pedal stride length is determined by the movements of an operator. Crank arms are positioned on the framework forward the operator at a height comparable to the pedals. Easy starting occurs in the default mode.

20 Claims, 5 Drawing Sheets

FREE PACE ELLIPTICAL EXERCISE APPARATUS

This application is a continuation-in-part of U.S. patent application Ser. No. 12/799,909 filed May 5, 2010 now U.S. Pat. No. 8,133,159 incorporating all of these by reference.

BACKGROUND OF THE INVENTION

1. Field

The present invention relates to a standup exercise apparatus that simulates walking and jogging with arm exercise. More particularly, the present invention relates to an exercise machine having separately supported pedals for the feet and arm exercise coordinated with the motion of the feet where the pedal stride length is determined by the movements of an operator. Crank arms are positioned forward the operator at pedal height.

2. State of the Art

The benefits of regular exercise to improve overall health, appearance and longevity are well documented in the literature. For exercise enthusiasts the search continues for safe apparatus that provides full body exercise for maximum benefit in minimum time.

Recently, a new category of exercise equipment has appeared on the commercial market called varying stride elliptical cross trainers. These cross trainers guide the feet along a closed loop shaped curve to simulate the motions of jogging and climbing with varying stride lengths. The shorter stride lengths have pedals which follow up and down curves that are generally arcuate in shape causing difficult startup. The longer stride lengths have pedals which follow closed loop curves having more of a banana shape than elliptical. There is a need for a variable stride exercise apparatus capable of long, medium and shorter stride lengths where the pedals always follow generally elliptical curve paths with easy startup.

Varying stride elliptical cross trainers are shown without cams in Rodgers, Jr. US Patent Applications 2009/0181828 and 2009/0156369 as well as U.S. Pat. Nos. 7,828,698, 7,520,839 and 7,530,926 which show a pendulum striding exercise apparatus having a foot support members hung from a generally horizontal beam pivoted to achieve the varying stride length pedal curves. Rodgers, Jr. in US Patent Application 2009/0156370 and U.S. Pat. No. 7,507,184 show exercise apparatus with flexible support elements having varying stride lengths. Miller in U.S. Patent Applications 2009/0105049 and 2011/0172062 also shows an exercise apparatus having varying stride lengths. Eschenbach in U.S. Pat. Nos. 7,841,968, 7,938,754 and 8,029,416 shows user defined motion elliptical exercise apparatus with a default elongate curve for easy starting. Chuang et al. in U.S. Pat. No. 7,608,018 shows a front drive user defined motion elliptical apparatus. Grind in U.S. Pat. No. 7,922,625 shows an adaptive motion exercise device with oscillating track. Ohrt et al. in U.S. Pat. No. 7,942,787 shows several adaptive motion rear drive exercise apparatus.

It is an objective of this invention to provide an exercise apparatus having varying stride lengths determined by the movement of an operator with a default mode for easy starting. A further objective is an exercise apparatus having varying stride lengths where the pedals follow elliptical curves for short, medium and long stride lengths.

SUMMARY OF THE INVENTION

The present invention relates to the kinematic motion control of pedals which simulate walking and jogging during operation. More particularly, apparatus is provided that offers variable intensity exercise through a leg operated cyclic motion in which the pedal supporting each foot is guided through successive positions during the motion cycle while a load resistance acts upon the mechanism.

The pedals are guided through an oblong curve motion while pedal angles are controlled to vary about the horizontal during the pedal cycle. Arm exercise is by handles coordinated with the mechanism guiding the foot pedals. The range of handle movement generally determines the pedal stride length.

In the original embodiment, the apparatus includes a separate pedal for each foot attached to a foot support member. A pair of crank arms rotate about a pivot axis positioned on the framework. A pair of support links are pivotally connected intermediate the ends to the crank arms and to foot support members. A pair of tracks are supported by the framework where a track actuator can change the incline. A pair of rollers are each rotatably attached to a respective foot support member and maintain rollable contact with a respective track. A pair of handles are attached to handle supports which are pivotally connected to the framework. A pair of connector links are pivotally connected to the handle supports and to one end of the support links. A cross member is pivotally connected to the framework. A pair of crossing links are pivotally connected to the cross member and to each handle support. The crossover member and crossing links form a crossover assembly to cause one handle to move forward while the other handle moves rearward.

The stride length of the pedal is generally determined by the range of movement of the handles. The shortest stride length occurs with no movement of the handles while the longest stride length of the pedals occurs with the longest range of movement of the handles. An even shorter stride is possible using only the feet to determine stride length with the hands of the user positioned upon the framework.

Load resistance is applied to the crank in this embodiment by a pulley which drives a belt to a smaller pulley attached to a flywheel supported by the framework. A tension belt covers the circumference of the flywheel to provide friction for load resistance on the intensity of exercise. A control system can adjust the tension on the tension belt through a load actuator to vary the intensity of exercise. It should be understood that other forms of load resistance such as magnetic, alternator, air fan or others may be applied to the crank. The control system also can adjust the incline of the tracks with the track actuator during operation to further change the intensity of exercise.

In the preferred embodiment, the apparatus includes a separate pedal for each foot attached to a foot support member. A pair of crank arms rotate about a pivot axis positioned on the framework forward an operator at generally pedal height. A pair of drive links are attached to the crank arms. Drive support links are pivotally connected to the drive links and the framework. A pair of support links are pivotally connected to the drive links and to the foot support members. A pair of rocker link guides are pivotally connected to the framework and to the foot support members. A pair of control links with handles attached are pivotally connected to the framework. A pair of connector links are pivotally connected to the control links and to the support links. A cross member is pivotally connected to the framework. A pair of crossing links are pivotally connected to the cross member and to each control link. The crossover member and crossing links form a crossover assembly to cause one handle to move forward while the other handle moves rearward. Energy storage devices are connected to the control links and framework to establish a default position for the control links that is generally vertical.

The stride length of the pedal is related to the range of movement of the handle. The shortest stride length occurs with no movement of the handles in the default mode for easy starting while the longest stride length of the pedals occurs with the longest range of movement of the handles.

Load resistance is applied to the crank in this embodiment by a pulley which drives a belt to a smaller pulley attached to a flywheel supported by the framework. A tension belt covers the circumference of the flywheel to provide friction for load resistance on the intensity of exercise. An adjustment knob can adjust the tension-on the tension belt to vary the intensity of exercise. It should be understood that other forms of load resistance such as magnetic, alternator, air fan or others may be applied to the crank.

In an alternate embodiment, the rocker link guides are replaced with roller and track guides wherein the rollers are pivotally connected to the foot support members and the tracks are attached to the frame. The remainder of this embodiment is essentially the same as the alternate embodiment. Operation is the same as the preferred embodiment. Easy starting occurs in the default mode with the handles held stationary as the pedals follow a short elongate curve. The longer handle range followed by the movement of the operator, the longer the stride length becomes.

In summary, this invention provides varying elliptical stride lengths as determined by the movement of an operator. The pedals move through elongate curves that simulate walking and jogging with very low joint impact. Arm exercise has a variable range of motion coordinated with the pedal movements. Pedal curves remain generally elliptical in shape throughout the range of variation. Easy starting occurs in the default mode.

DETAILED DESCRIPTION OF THE EMBODIMENTS

Figure 1:
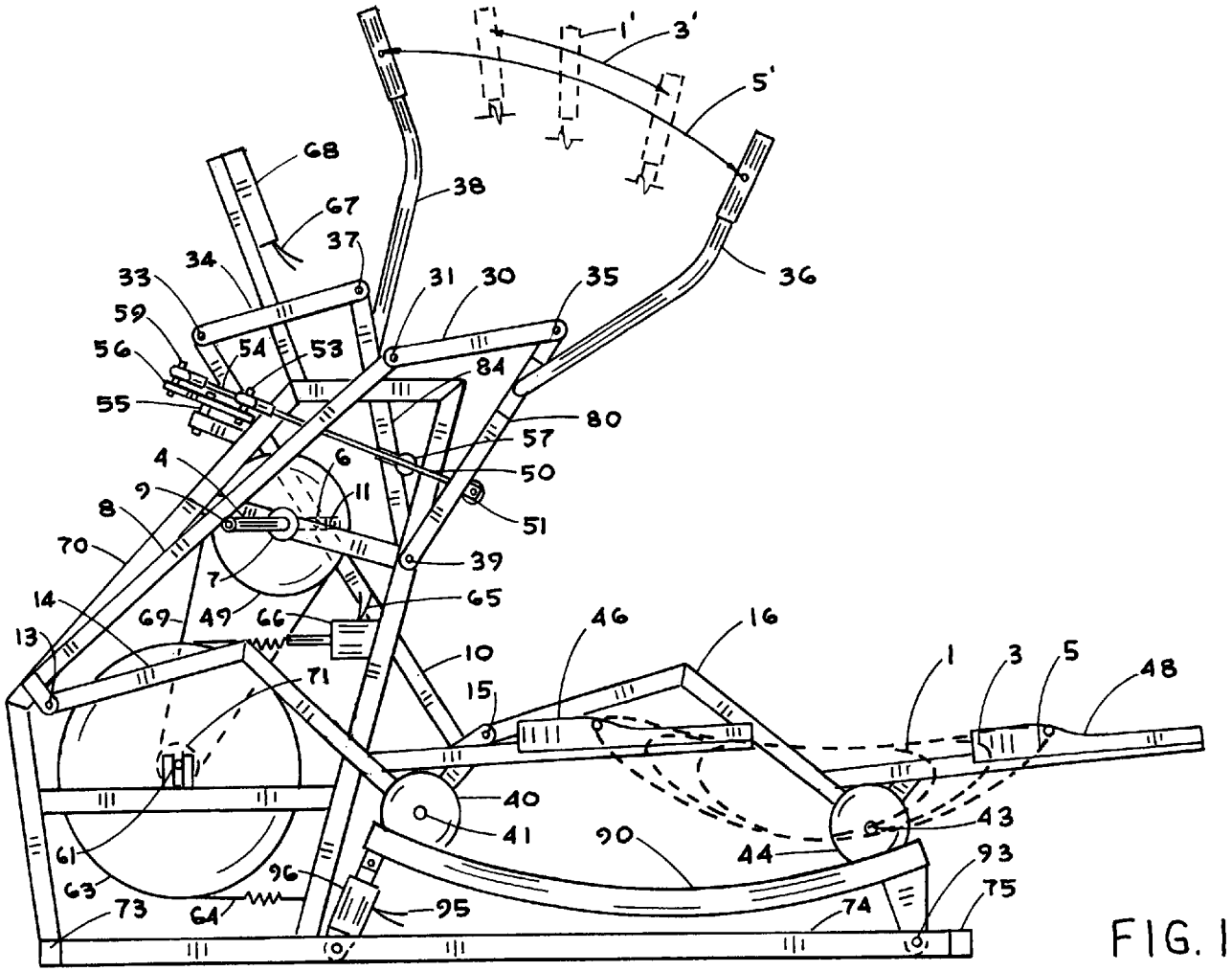
FIG. 1 is a left side elevation view of the original embodiment.
Figure 2:
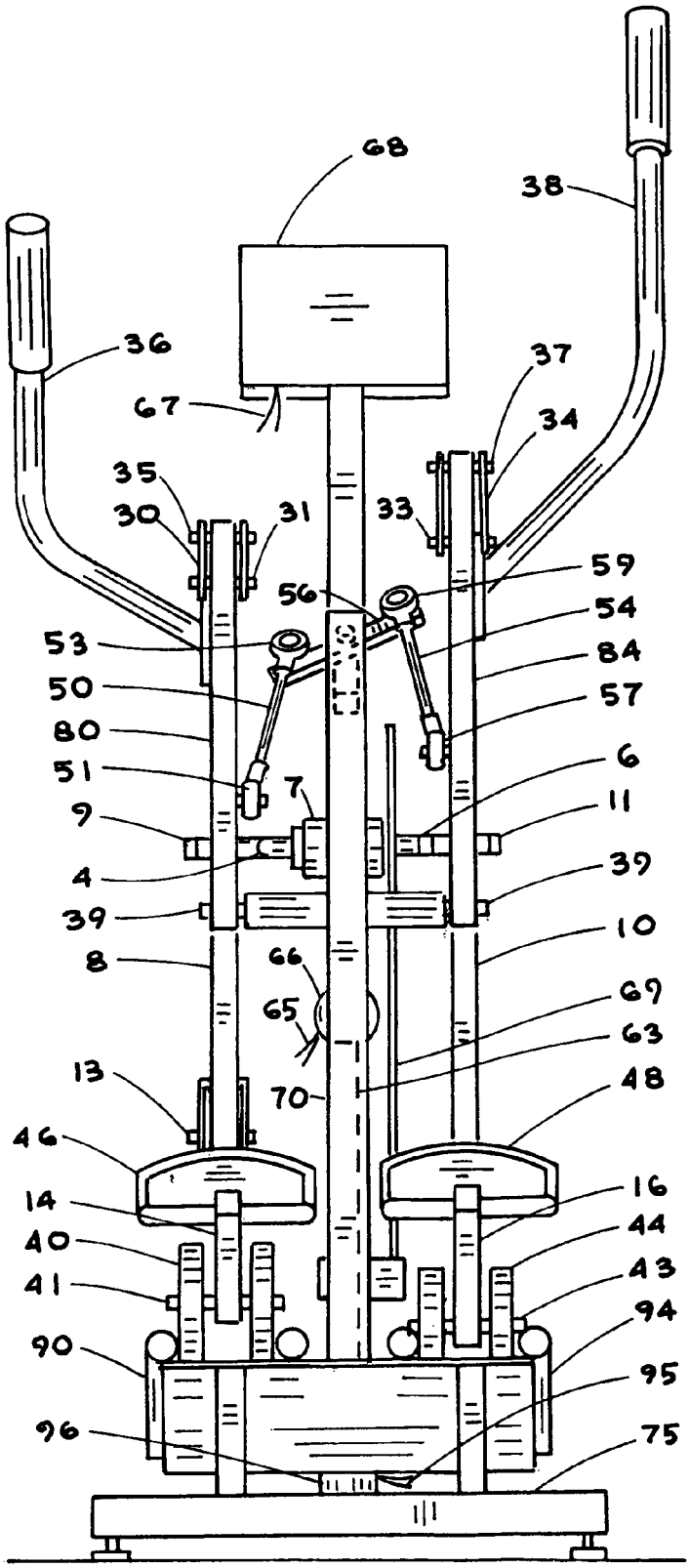
FIG. 2 is the rear view of the original embodiment shown in FIG. 1.

Referring to the drawings in detail, pedals 46 and 48 are shown in FIGS. 1 and 2 in forward and rearward positions of the preferred embodiment. Crank arms 4,6 rotate about pivot axis 7 on framework 70. Foot support members 14,16 have pedals 46,48 attached. Support links 8,10 are connected intermediate the ends to crank arms 4,6 at pivots 9,11 and to foot support members 14,16 at pivots 13,15. Tracks 90,94 are attached to frame members 74 at pivot 93 and to track actuator 96 which is also attached to framework 74. Rollers 40,44 are connected to foot support members 14,16 at pivots 41,43 and are in rollable contact with tracks 90,94.

Handles 36,38 are attached to handle supports 80,84 which are connected to framework 70 at pivot 39. Connector links 30,34 are connected to handle supports 80,84 at pivots 35,37 and to one end of support links 8,10 at pivots 31,33. Crossover member 56 is connected to framework 70 at pivot 55. Crossing links 50,54 are connected to crossover member 56 at pivots 53,59 and to handle supports 80,84 at pivots 51,57. Crossover member 56 and crossing links 50,54 form a crossover assembly as shown in FIGS. 1 and 2 that cause handle 36 to move forward when handle 38 moves rearward.

Load resistance is imposed upon cranks 4,6 by pulley 49 which drives flywheel 63 by belt 69 coupled to pulley 71 which is supported by the framework 70 at shaft 61. Tension belt 64 encompasses flywheel 63 with load actuator 66 connected for adjustment to vary the intensity of exercise on the exercise apparatus. Control system 68 is connected to load actuator 66 and track actuator 96 with wires 67,65,95 using conventional means not shown. Control system 68 can be programmed to adjust tension belt 64 using load actuator 66 or to change the incline of tracks 90,94 using track actuator 96 to vary the intensity of exercise during operation. Framework 70 is attached to longitudinal frame members 74 which are attached to cross members 73,75 that are supported by a generally horizontal surface.

Operation begins when an operator places the feet upon the pedals 46,48 in the default side by side position of pedals 46,48. Moving the handles 36,38 and applying body weight to pedals 46,48 starts the crank arms 4,6 moving with ease. Holding handles 36,38 generally still as denoted by handle position 1', pedals 46,48 move through a relatively short pedal curve 1 shown in FIG. 1. Allowing the handles 36,38 to move through handle range 3' causes pedals 46,48 to move along pedal curve 3. Allowing handles 36,38 to move through handle range 5' results in pedal curve 5. Even shorter pedal curves are possible when the user is not grasping the handles whereby only the feet of the user define the motion.

Figure 3:
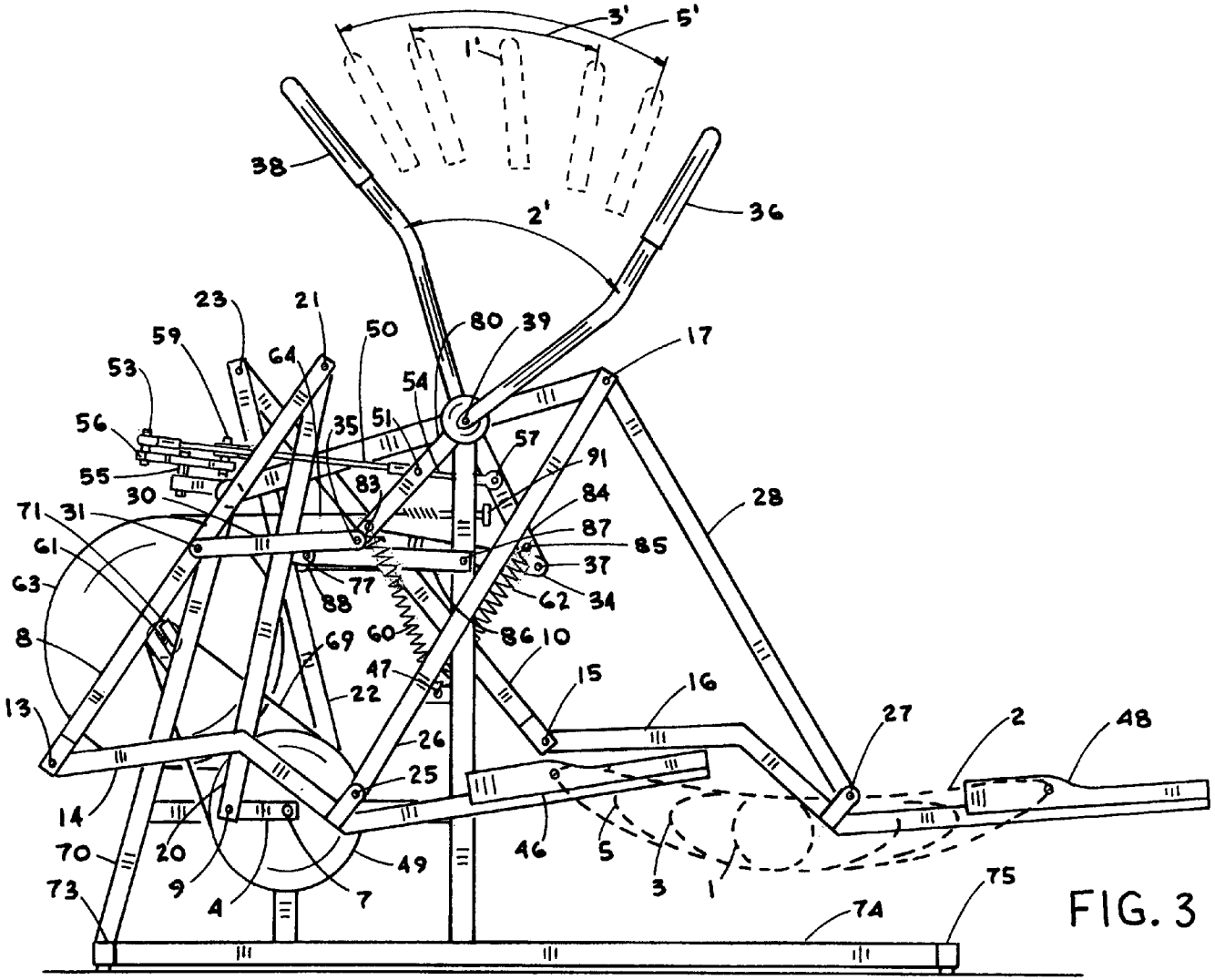
FIG. 3 is a left side elevation view of the preferred embodiment of an exercise machine constructed in accordance with the present invention.
Figure 4:
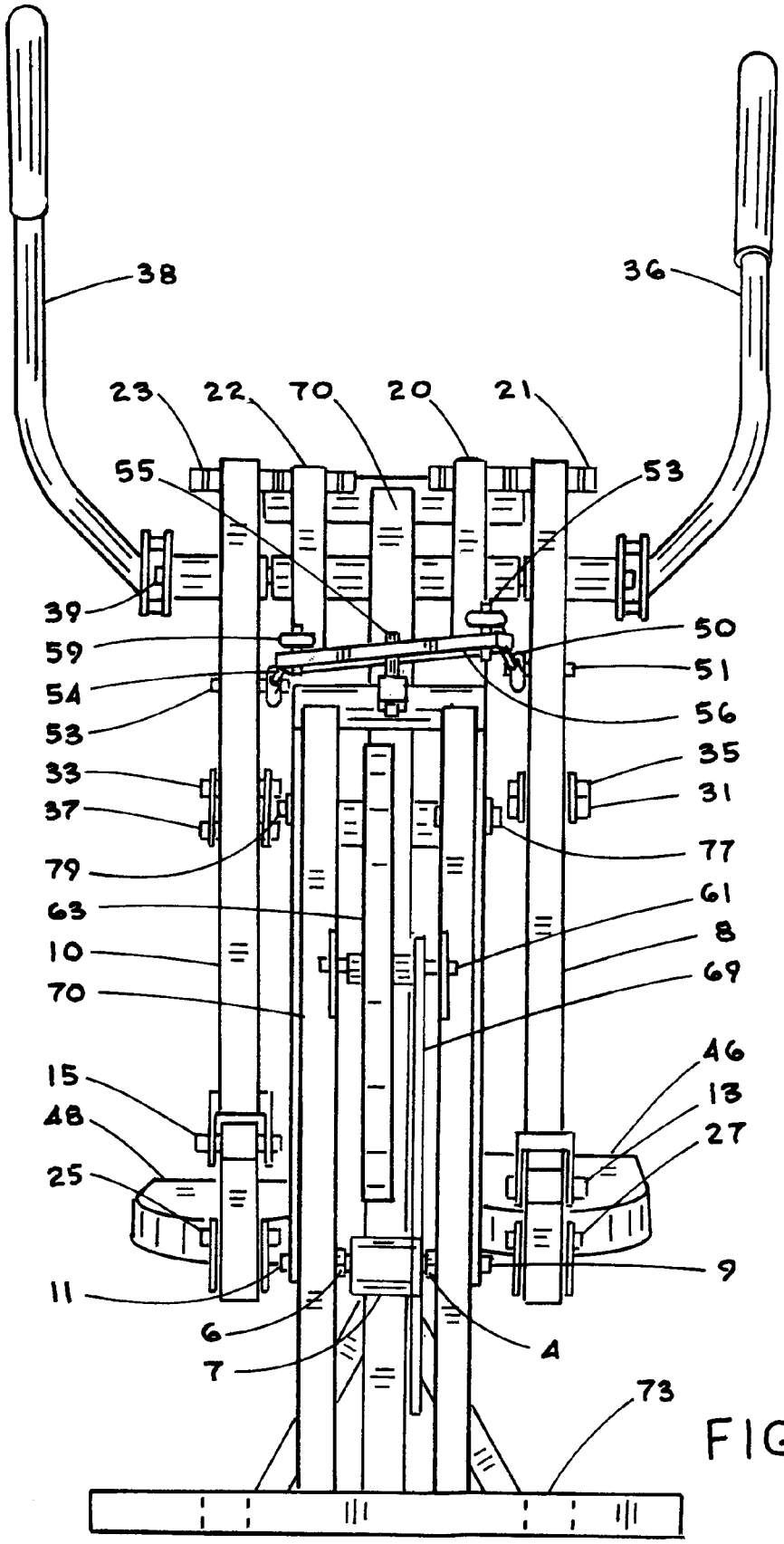
FIG. 4 is the front view of the preferred embodiment shown in FIG. 3.

In the preferred embodiment, pedals 46 and 48 are shown in FIGS. 3 and 4 in forward and rearward positions. Crank arms 4,6 rotate about pivot axis 7 positioned forward of an operator at generally pedal height on framework 70. Foot support members 14,16 have pedals 46,48 attached at the ends. Drive links 20,22 are connected to crank arms 4,6 at pivots 9,11. Drive link supports 86,88 are connected to drive links 20,22 at pivots 77,79 and to framework 70 at pivot 87. Support links 8,10 are connected to drive links 20,22 at pivots 21,23 and to foot support members 14,16 at pivots 13,15. Guides 26,28 are connected to framework 70 at pivot 17 and to foot support members 14,16 at pivots 25,27. For this embodiment, guides 26,28 are further described as rocker links 26,28.

Handles 36,38 are attached to control links 80,84 which are connected to framework 70 at pivot 39. Connector links 30,34 are connected to control links 80,84 at pivots 35,37 and to support links 8,10 at pivots 31,33. Crossover member 56 is connected to framework 70 at pivot 55. Crossing links 50,54 are connected to crossover member 56 at pivots 53,59 and to control links 80,84 at pivots 51,57. Crossover member 56 and crossing links 50,54 form a crossover assembly as shown in FIGS. 3 and 4 that cause control link 80 to move forward when control link 84 moves rearward.

Energy storage devices 60,62 are shown in FIGS. 3 and 4 as springs 60,62 connected to control links 80,84 at pivots 83,85 and to framework 70 at pivot 47. Springs 60,62 are intended to cause control links 80,84 to have a bias towards the default vertical position where the shortest stride occurs at elongate curve 1.

Load resistance is imposed upon cranks 4,6 by pulley 49 which drives flywheel 63 by belt 69 and pulley 71. Flywheel 63 is supported by framework 70 at pivot 61. Tension belt 64 encompasses flywheel 63 for adjustable load resistance using adjustment knob 91 to vary the intensity of exercise on the exercise apparatus. Framework 70 is attached to longitudinal frame members 74 and to cross members 73,75 that are supported by a generally horizontal surface.

Operation begins when an operator places the feet upon the pedals 46,48 in the default side by side position of pedals 46,48. In the default mode, control links 80,84 are caused to be generally vertical in a side by side position by springs 60,62. Other forms of energy storage devices 60,62 may also be used. In the default mode, pedals 46,48 will follow the shortest stride length along default elongate curve 1. Startup is easy along the default elongate curve 1. Handles 36,38 remain generally stationary at position 1' while pedals 46,48 follow elongate curve 1. When handles 36,38 move through handle range 3', pedals 46,48 move along pedal curve 3. When handles 36,38 move through an even greater handle range 5', pedals 46,48 follow pedal curve 5. The maximum stride occurs when pedals 46,48 follow pedal curve 2 while handles 36,38 have the handle range 2'.

Figure 5:
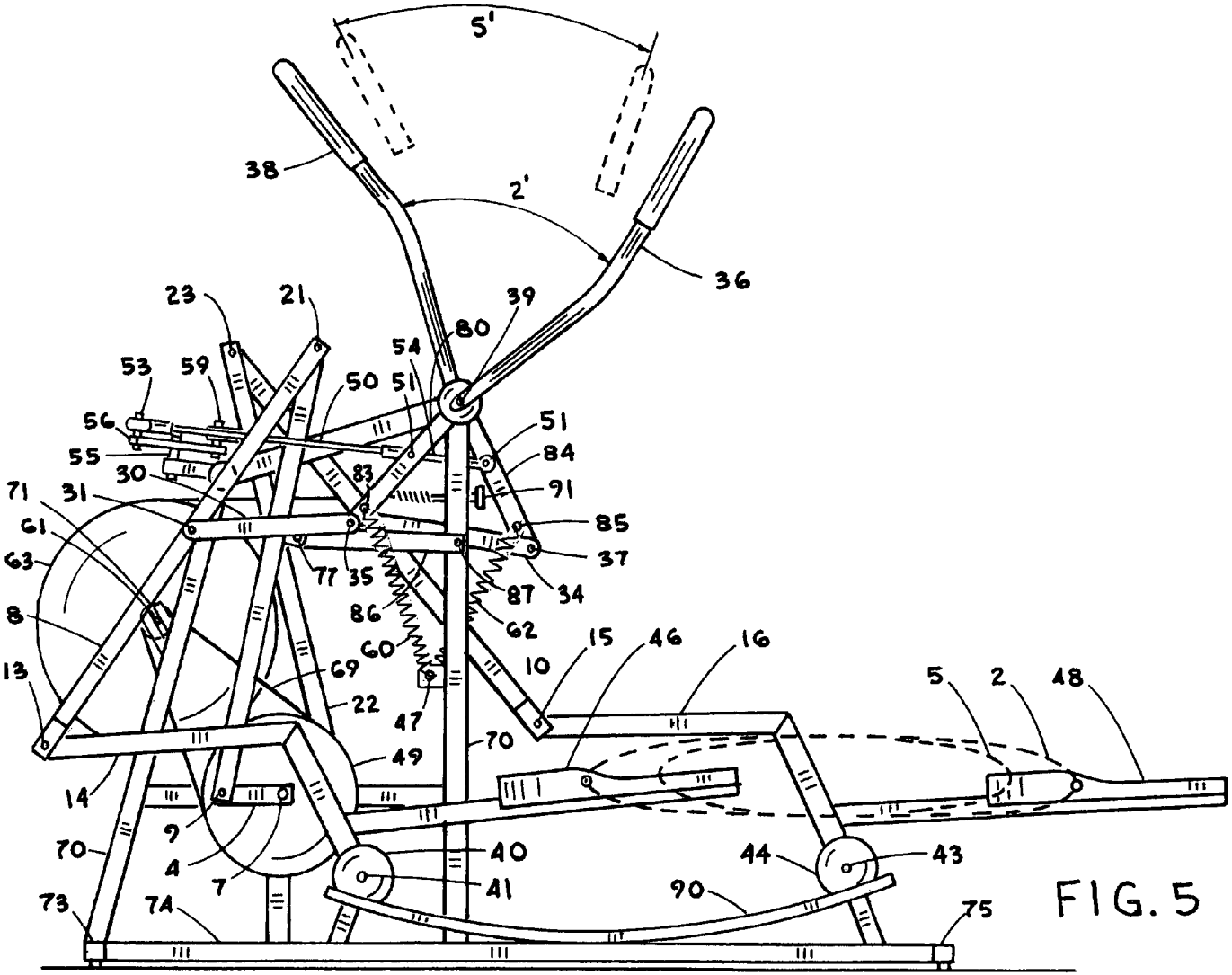
FIG. 5 is a left side elevation view of an alternate embodiment.

An alternate embodiment is shown in FIG. 5 which is essentially the same as the alternate embodiment shown in FIGS. 3 and 4 except that guides 26,28 have been replaced with rollers 40,44 and tracks 90 serving as guides. Tracks 90 are attached to framework 70 and 74 at a predetermined angle. However, as shown in FIGS. 1 and 2 tracks 90 can be configured to have adjustable angles. Rollers 40,44 are connected to the foot support members 14,16 at pivots 41,43. The remainder of this alternate embodiment is essentially the same as the preferred embodiment of FIGS. 3 and 4. Operation is the same as the preferred embodiment where only pedal curves 2 and 5 are being shown in FIG. 5.

In summary, the present invention has distinct advantages over prior art because the elliptical stride movement of the pedals 46,48 change with the range of movement 1',3',5',2' of the handles 36,38 while maintaining a generally elliptical pedal curves 1,3,5,2 even for the longest pedal stride. Easy starting occurs in the default mode.

The present invention may be embodied in other specific forms without departing from its spirit or essential characteristics. The described embodiments are to be considered in all respects only as illustrative, and not restrictive. The scope of the invention is, therefore, indicated by the claims, rather than by foregoing description. All changes which come within the meaning and range of equivalency of the claims are to be embraced within their scope.

What is claimed is:

1. An exercise apparatus comprising;

a framework, said framework configured to be supported on a generally horizontal surface;

a pair of crank arms, said crank arms being connected to rotate about a pivot axis positioned on said framework;

a pair of drive links, each said drive link pivotally connected to a respective said crank arm;

a pair of drive link supports, each said drive link support pivotally connected to a respective said drive link and to said framework;

a pair of foot support members, each said foot support member having a foot engaging pedal attached;

a pair of support links, each said support link pivotally connected to a respective said drive link and to one end of a respective said foot support member;

a pair of guides, each said guide operably associated with the intermediate portion of a respective said foot support member and with said framework;

a pair of control links, each said control link pivotally connected to said framework;

a pair of connector links, each said connector link pivotally connected to a respective said control link and to a respective said support link;

a crossover assembly, said crossover assembly operably associated with said control link to cause one said pedal to move in a direction opposed to the other said pedal;

said pedals configured to move relative to said framework when the foot of an operator is rotating said crank arms whereby said pedals follow an elongate curve path wherein the stride length of said elongate curve path is determined by the movement of said operator.

2. The exercise apparatus according to claim 1 wherein said guide comprises a rocker link, said rocker link pivotally connected to a respective said foot support member and to said framework.

3. The exercise apparatus according to claim 1 wherein said crossover assembly comprises:

a crossover member, said crossover member pivotally connected to said framework intermediate the ends of said crossover member;

a pair of crossing links, each said crossing link pivotally connected to one end of said crossover member and to a respective said control link whereby forward movement of one said control link causes the rearward movement of the other said control link.

4. The exercise apparatus according to claim 1 wherein said guide comprises a roller and track, said track attached to said framework and said roller pivotally connected to a respective said foot support member and in rollable contact with said track.

5. The exercise apparatus according to claim 1 further comprising an adjustable load resistance device, said adjustable load resistance device operably associated with said crank arms.

6. The exercise apparatus according to claim 1 further comprising a pair of handles for arm exercise, each said handle attached to a respective said control link.

7. The exercise apparatus according to claim 6 wherein the movement of said handles corresponds to said stride length.

8. The exercise apparatus according to claim 1 further comprising a pair of energy storage devices, each said energy storage device operably associated with a respective said control link and said framework to cause said control link to be biased towards a vertical position.

9. An exercise apparatus comprising;

a framework, said framework configured to be supported on a generally horizontal surface;

a pair of crank arms, said crank arms being connected to rotate about a pivot axis positioned on said framework forward an operator and at an elevation comparable to the movement of the feet of said operator;

a pair of drive links, each said drive link pivotally connected at one end to a respective said crank arm;

a pair of drive link supports, each said drive link support pivotally connected to a respective said drive link and to said framework;

a pair of foot support members, each said foot support member having a foot engaging pedal attached;

a pair of support links, each said support link pivotally connected to the other end of a respective said drive link and to one end of a respective said foot support member;

a pair of guides, each said guide operably associated with the intermediate portion of a respective said foot support member and with said framework;

a pair of handles for arm exercise, each said handle pivotally connected to said framework;

a pair of control links, each said control link attached to a respective said handle;

a pair of connector links, each said connector link pivotally connected to a respective said control link and to the intermediate portion of a respective said support link;

a crossover member, said crossover member pivotally connected to said framework intermediate the ends of said crossover member;

a pair of crossing links, each said crossing link pivotally connected to one end of said crossover member and to a respective said control link such that forward movement of one said control link causes the rearward movement of the other said control link;

said pedals configured to move relative to said framework when the foot of said operator is rotating said crank arms whereby said pedals follow an elongate curve path wherein the stride length of said elongate curve path is determined by the movement of said operator.

10. The exercise apparatus according to claim 9 further comprising a flywheel, said flywheel operably associated with said crank arms.

11. The exercise apparatus according to claim 9 further comprising an adjustable load resistance device, said adjustable load resistance device operably associated with said crank arms.

12. The exercise apparatus according to claim 9 further comprising a pair of energy storage devices, each said energy storage device operably associated with a respective said control link and said framework to cause said control link to be biased towards a vertical position.

13. The exercise apparatus according to claim 9 wherein said guide comprises a rocker link, said rocker link pivotally connected to a respective said foot support member and to said framework.

14. The exercise apparatus according to claim 9 wherein said guide comprises a roller and track, said track attached to said framework and said roller pivotally connected to a respective said foot support member and in rollable contact with said track.

15. An exercise apparatus configured for operator defined motion comprising;

a framework, said framework configured to be supported on a generally horizontal surface;

a pair of crank arms, said crank arms being connected to rotate about a pivot axis positioned on said framework forward said operator adjacent said horizontal surface;

a pair of drive links, each said drive link pivotally connected at one end to a respective said crank arm;

a pair of drive link supports, each said drive link support pivotally connected to a respective said drive link and to said framework;

a pair of foot support members, each said foot support member having a first portion, a second portion and a foot engaging pedal;

a pair of support links, each said support link pivotally connected to a respective said drive link and a respective said foot support member to cause said first portion of said foot support member to have a generally orbital motion;

a pair of guides, each said guide operably associated with said second portion of a respective said foot support member and with said framework to cause said second portion to have a generally back and forth motion;

a pair of handles for arm exercise, each said handle pivotally connected to said framework;

a pair of control links, each said control link attached to a respective said handle;

a pair of connector links, each said connector link pivotally connected to a respective said control link and to a respective said support link;

a crossover assembly, said crossover assembly operably associated with said control links to cause one said pedal to move in a direction opposed to the other said pedal;

said pedals configured to move relative to said framework when the foot of said operator is rotating said crank arms whereby said pedals follow an elongate curve path wherein the stride length of said elongate curve path is determined by the range of movement of said handles.

16. The exercise apparatus according to claim 15 wherein said foot support member is configured with said pedal positioned at one end and said first portion at the other end.

17. The exercise apparatus according to claim 15 wherein said crossover assembly comprises:

a crossover member, said crossover member pivotally connected to said framework intermediate the ends of said crossover member;

a pair of crossing links, each said crossing link pivotally connected to one end of said crossover member and to a respective said control link whereby forward movement of one said handle causes the rearward movement of the other said handle.

18. The exercise apparatus according to claim 15 wherein said guide comprises a roller and track, said track attached to said framework and said roller pivotally connected to a respective said foot support member and in rollable contact with said track.

19. The exercise apparatus according to claim 15 wherein said guide comprises a rocker link, said rocker link pivotally connected to the second portion of a respective said foot support member and to said framework.

20. The exercise apparatus according to claim 15 further comprising a pair of energy storage devices, each said energy storage device operably associated with a respective said control link and said framework to cause said control link to be biased towards a vertical position.

* * * * *